US007896136B2

(12) United States Patent
Shibata et al.

(10) Patent No.: US 7,896,136 B2
(45) **Date of Patent: *Mar. 1, 2011**

(54) ELEVATOR APPARATUS WITH BRAKE CONTROL DEVICE

(75) Inventors: Masunori Shibata, Chiyoda-ku (JP); Takaharu Ueda, Chiyoda-ku (JP); Satoru Takahashi, Chiyoda-ku (JP); Ken-Ichi Okamoto, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 908 days.

This patent is subject to a terminal disclaimer.

(21) Appl. No.: 11/794,321

(22) PCT Filed: Mar. 2, 2006

(86) PCT No.: PCT/JP2006/303961

§ 371 (c)(1),
(2), (4) Date: Jun. 28, 2007

(87) PCT Pub. No.: WO2007/099633

PCT Pub. Date: Sep. 7, 2007

(65) Prior Publication Data

US 2010/0032245 A1 Feb. 11, 2010

(51) Int. Cl.
*B66B 1/32* (2006.01)

(52) U.S. Cl. ..... 187/288; 187/287; 187/391

(58) Field of Classification Search ..... 187/247, 187/277, 287, 288, 291–293, 296, 297, 391–393
See application file for complete search history.

(56) References Cited

U.S. PATENT DOCUMENTS

| | | | | |
|---|---|---|---|---|
| 6,173,814 | B1 * | 1/2001 | Herkel et al. | 187/288 |
| 7,669,697 | B2 * | 3/2010 | Ueda et al. | 187/391 |
| 7,730,998 | B2 * | 6/2010 | Takahashi et al. | 187/288 |
| 7,735,610 | B2 * | 6/2010 | Huard et al. | 187/288 |
| 2009/0229924 | A1 * | 9/2009 | Kondo et al. | 187/288 |
| 2009/0255764 | A1 * | 10/2009 | Ueda et al. | 187/288 |
| 2009/0266649 | A1 * | 10/2009 | Kondo et al. | 187/288 |
| 2010/0025162 | A1 * | 2/2010 | Okamoto et al. | 187/288 |
| 2010/0101896 | A1 * | 4/2010 | Ueda et al. | 187/288 |
| 2010/0155183 | A1 * | 6/2010 | Takahashi et al. | 187/288 |

FOREIGN PATENT DOCUMENTS

| | | |
|---|---|---|
| JP | 7 157211 | 6/1995 |
| JP | 7 206288 | 8/1995 |
| JP | 7 242377 | 9/1995 |
| JP | 8-40662 | 2/1996 |
| JP | 2004 231355 | 8/2004 |

* cited by examiner

*Primary Examiner* — Jonathan Salata
(74) *Attorney, Agent, or Firm* — Oblon, Spivak, McClelland, Maier & Neustadt, L.L.P.

(57) ABSTRACT

In an elevator apparatus, a brake device is controlled by a brake control device. The brake control device has a first brake control portion for operating the brake device to stop a car as an emergency measure upon detection of an abnormality, and a second brake control portion for reducing a braking force of the brake device when a deceleration of the car becomes equal to or larger than a predetermined value during emergency braking operation of the first brake control portion. The second brake control portion controls the brake device independently of the first brake control portion.

6 Claims, 6 Drawing Sheets

ELEVATOR APPARATUS WITH BRAKE CONTROL DEVICE

TECHNICAL FIELD

The present invention relates to an elevator apparatus having a brake control device for controlling a brake device.

BACKGROUND ART

In a conventional brake device for an elevator, a braking force of an electromagnetic brake is controlled at the time of emergency braking such that a deceleration of a car becomes equal to a predetermined value, based on a deceleration command value and a speed signal (e.g., see Patent Document 1).

Patent Document 1: JP 07-157211 A

DISCLOSURE OF THE INVENTION

Problem to be Solved by the Invention

In recent years, by the way, reduction of the inertia around a rotary shaft has been promoted through the weight saving of a car and adoption of a gearless hoisting machine, and attempts to reduce the capacities of a motor and a control device and realize the energy saving thereof have been made. However, there is a problem in that the deceleration of the car becomes excessively large to the extent of discomforting passengers when the running car is stopped as an emergency measure.

The present invention has been made to solve the above-mentioned problem, and it is therefore an object of the present invention to provide, independently of a normal brake device, a brake control device for preventing the deceleration of a car from becoming excessively large at the time of emergency braking.

Means for Solving the Problems

An elevator apparatus according to the present invention includes: a car; a brake device for stopping the car from running; and a brake control device for controlling the brake device, in which: the brake control device has a first brake control portion for operating the brake device to stop the car as an emergency measure upon detection of an abnormality, and a second brake control portion for reducing a braking force of the brake control portion when a deceleration of the car becomes equal to or larger than a predetermined value during emergency braking operation of the first brake control portion; and the second brake control portion controls the brake device independently of the first brake control portion.

BEST MODE FOR CARRYING OUT THE INVENTION

Preferred embodiments of the present invention will be described hereinafter with reference to the drawings.

Embodiment 1

Figure 1:
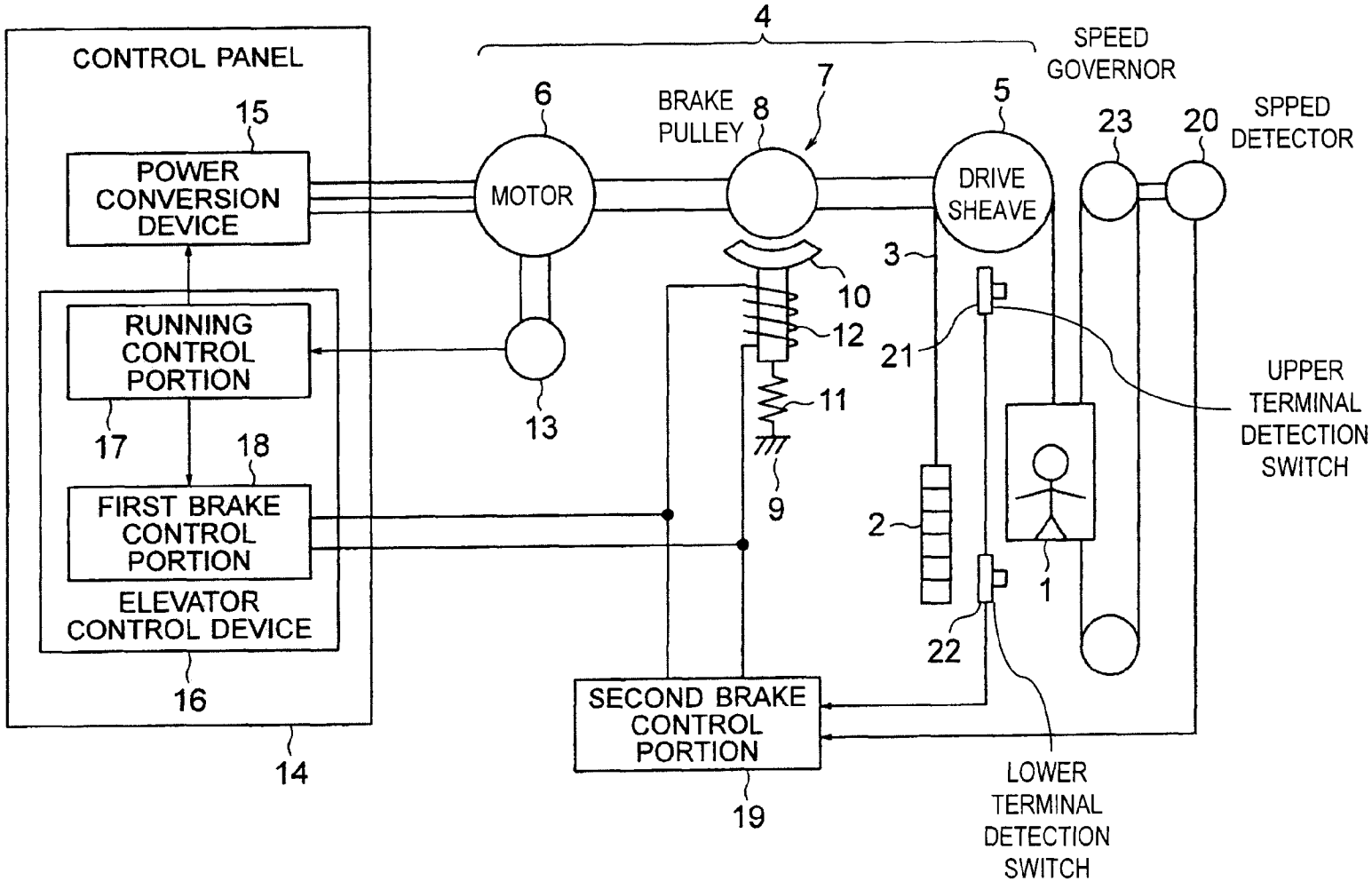
FIG. 1 is a schematic diagram showing an elevator apparatus according to Embodiment 1 of the present invention.

FIG. 1 is a schematic diagram showing an elevator apparatus according to Embodiment 1 of the present invention. A car 1 and a counterweight 2, which are suspended within a hoistway by means of a main rope 3, are raised/lowered within the hoistway with the aid of a driving force of a hoisting machine 4. The hoisting machine 4 has a drive sheave 5 around which the main rope 3 is looped, a motor 6 for rotating the drive sheave 5, and braking means 7 for braking rotation of the drive sheave 5.

The braking means 7 has a brake pulley 8 that is rotated integrally with the drive sheave 5, and a brake device 9 for braking rotation of the brake pulley 8. The brake device 9 has a brake shoe 10 that is moved into contact with and away from the brake pulley 8, a brake spring 11 for pressing the brake shoe 10 against the brake pulley 8, and a brake release coil 12 for opening the brake shoe 10 away from the brake pulley 8 against the brake spring 11.

The motor 6 is provided with a rotation detector 13 for generating a signal corresponding to a rotational speed of a rotary shaft of the motor 6, namely, a rotational speed of the drive sheave 5. Employed as the rotation detector 13 is, for example, an encoder or a resolver.

A control panel 14 is provided with a power conversion device 15 such as an inverter for supplying power to the motor 6, and an elevator control device 16. The elevator control device 16 has a running control portion 17 and a first brake control portion (main control portion) 18. The running control portion 17 controls the power conversion device 15 and the first brake control portion 18 in accordance with a signal from the rotation detector 13. The first brake control portion 18 controls the brake device 9 in accordance with a command from the running control portion 17 and a signal from the rotation detector 13.

More specifically, when the car 1 is stopped at a stop floor during normal operation, the first brake control portion 18 causes the brake device 9 to perform braking operation to maintain a stationary state of the car 1. Also, when a command to stop the car 1 as an emergency measure is issued, the first brake control portion 18 causes the brake device 9 to perform braking operation. Thus, rotation of the brake pulley 8 and rotation of the drive sheave 5 are braked, so the car 1 is braked as an emergency measure.

The brake device 9 is controlled by a second brake control portion (deceleration restraining portion) 19 as well. When the deceleration (the absolute value of a negative acceleration) of the car 1 becomes equal to or larger than a predetermined value during emergency braking operation of the first brake control portion 18, the second brake control portion 19 reduces the braking force of the brake device 9 and controls the brake device 9 such that the deceleration of the car 1 is held smaller than the predetermined value. The second brake control portion 19, which is connected in parallel with the elevator control device 16 to the brake device 9, can reduce the braking force of the brake device 9 independently of the first brake control portion 18.

A signal from a car speed detector 20 for generating a signal corresponding to a speed of the car 1, a signal from an upper terminal detection switch 21 installed in the vicinity of an upper terminal floor within the hoistway, and a signal from a lower terminal detection switch 22 installed in the vicinity of a lower terminal floor within the hoistway are input to the second brake control portion 19. The car speed detector 20 is provided on a speed governor 23.

The second brake control portion 19 calculates a deceleration of the car 1 based on the signal from the car speed detector 20. The second brake control portion 19 detects the arrival of the car 1 in the vicinity of each of the terminal floors based on the signal from a corresponding one of the terminal detection switches 21 and 22.

The elevator control device 16 is constituted by a first computer having a calculation processing unit (CPU), a storage portion (ROM, RAM, hard disk, and the like), and signal input/output portions. That is, the functions of the running control portion 17 and the first brake control portion 18 are realized by the first computer. Programs for realizing the functions of the running control portion 17 and the first brake control portion 18 are stored in the storage portion of the first computer.

The second brake control portion 19 is constituted by a second computer. That is, the function of the second brake control portion 19 is realized by the second computer. A program for realizing the function of the second brake control portion 19 is stored in a storage portion of the second computer. A brake control device has the first brake control portion 18 and the second brake control portion 19.

Figure 2:
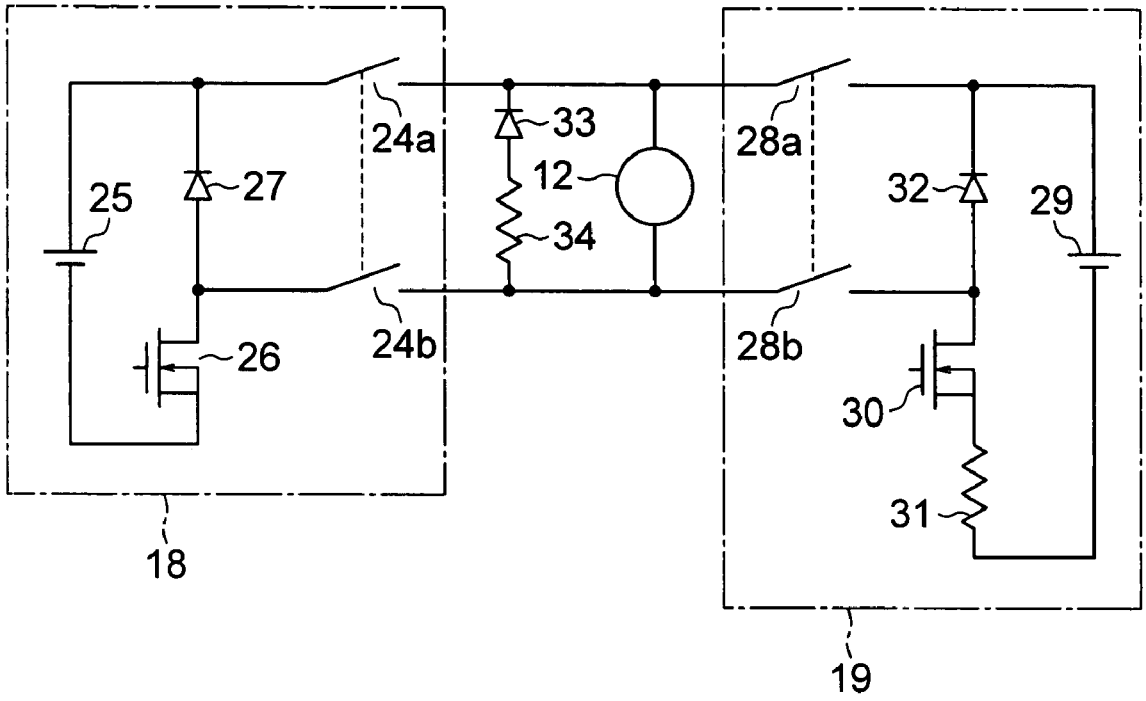
FIG. 2 is a circuit diagram showing a control circuit for controlling a brake device of FIG. 1.

FIG. 2 is a circuit diagram showing a control circuit for controlling the brake device 9 of FIG. 1. The first brake control portion 18 and the second brake control portion 19 are connected in parallel to the brake release coil 12. That is, when power is supplied to the brake release coil 12 from at least one of the first brake control portion 18 and the second brake control portion 19, the braking force of the brake device 9 is canceled.

The first brake control portion 18 closes a pair of first contacts 24*a* and 24*b* to supply power from a first power supply 25 to the brake release coil 12. A first semiconductor switch 26 such as a MOS-FET is connected between the first power supply 25 and the first contact 24*b*. The first semiconductor switch 26 generates an average voltage corresponding to the ratio between an ON time and an OFF time through high-speed switching (step-down chopper).

A first circulating current diode 27 is connected in parallel with the brake release coil 12 to the first power supply 25. The first circulating current diode 27 protects the circuit from a back electromotive force generated by the brake release coil 12.

The second brake control portion 19 closes a pair of second contacts 28*a* and 28*b* to supply power from a second power supply 29 to the brake release coil 12. A second semiconductor switch 30 such as a MOS-FET and a resistor 31 as a current limiting resistor are connected in series between the second power supply 29 and the second contact 28*b*.

The second semiconductor switch 30 generates an average voltage corresponding to the ratio between an ON time and an OFF time through high-speed switching (step-down chopper). The second semiconductor switch 30 is controlled by a command signal generated by the second computer constituting the second brake control portion 19. The resistor 31 limits the current flowing through the brake release coil 12 even when there is an ON malfunction in the second semiconductor switch 30.

A second circulating current diode 32 is connected in parallel with the brake release coil 12 to the second power supply 29. The second circulating current diode 32 protects the circuit from a back electromotive force generated by the brake release coil 12.

A circuit in which a diode 33 and a resistor 34 are connected in series to each other is connected in parallel to the brake release coil 12. The circuit composed of the diode 33 and the resistor 34 promptly consumes a back electromotive force that is generated by the brake release coil 12 when the first contacts 24*a* and 24*b* or the second contacts 28*a* and 28*b* are opened.

Figure 3:
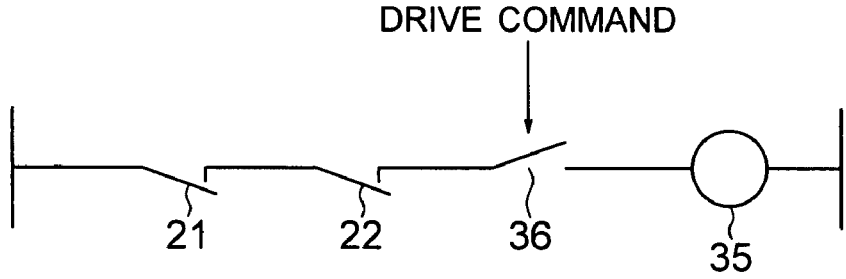
FIG. 3 is a circuit diagram showing a circuit for driving second contacts of FIG. 2.

FIG. 3 is a circuit diagram showing a circuit for driving the second contacts 28*a* and 28*b* of FIG. 2. The second contacts 28*a* and 28*b* are closed by exciting a contact driving coil 35, and opened by shutting off the supply of current to the contact driving coil 35. The upper terminal detection switch 21, the lower terminal detection switch 22, and a brake control switch 36 are connected in series to the contact driving coil 35.

When the car 1 is located within a predetermined distance from an upper end or a lower end of the hoistway, the terminal detection switch 21 or 22 is opened, respectively, to shut off the supply of current to the contact driving coil 35. Accordingly, when the car 1 is located within the predetermined distance from the upper end or the lower end of the hoistway, the second contacts 28*a* and 28*b* are opened, so the control of braking force performed by the second brake control portion 19 is invalidated. The brake control switch 36 is closed/opened in accordance with a drive command generated by the second computer constituting the second brake control portion 19.

The second brake control portion 19 monitors the speed of the car 1 based on a signal from the car speed detector 20. When the speed of the car 1 becomes equal to or higher than a first threshold VH, the second brake control portion 19 closes the second contacts 28*a* and 28*b*. When the speed of the car 1 becomes equal to a second threshold VL (VH>VL) while the second contacts 28*a* and 28*b* are in their closed states, the second brake control portion 19 opens the second contacts 28*a* and 28*b*.

The second brake control portion 19 also monitors the deceleration of the car 1 based on a signal from the car speed detector 20. When the deceleration of the car 1 becomes equal to or larger than a predetermined value while the second contacts 28*a* and 28*b* are closed, the second brake control portion 19 turns the second semiconductor switch 30 ON to urge the brake release coil 12. That is, when the acceleration of the car 1 becomes equal to or smaller than a predetermined value $\alpha L$ while the second contacts 28*a* and 28*b* are closed, the second brake control portion 19 turns the second semiconductor switch 30 ON.

In addition, when the deceleration of the car 1 becomes equal to or larger than the predetermined value and the second semiconductor switch 30 is turned ON, the second brake control portion 19 starts measuring time by means of a timer circuit. When a predetermined time Tm elapses after the start of the measurement of time by the timer circuit, the second brake control portion 19 opens the second contacts 28*a* and 28*b* to deenergize the brake release coil 12.

Figure 4:
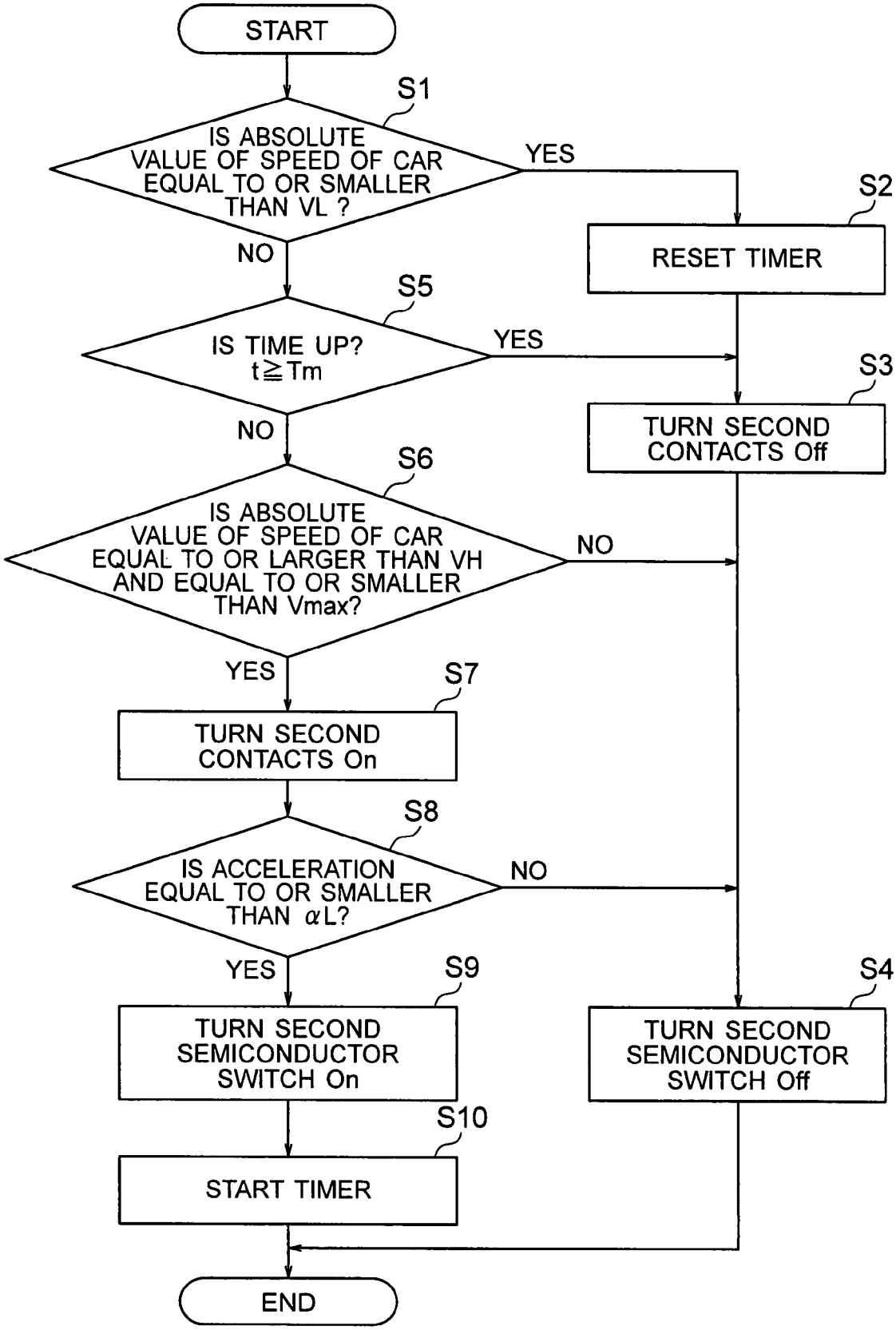
FIG. 4 is a flowchart showing the operation of a second brake control portion of FIG. 1.

Next, an operation will be described. FIG. 4 is a flowchart showing the operation of the second brake control portion 19 of FIG. 1. The second brake control portion 19 repeatedly performs the operation shown in FIG. 4 on a predetermined cycle. This cycle is sufficiently shorter than a time required for an emergency stop of the car 1.

The second brake control portion 19 determines whether or not the absolute value of the speed of the car 1 is equal to or smaller than the second threshold VL (Step S1). When the absolute value of the speed of the car 1 is equal to or smaller than the second threshold VL, the second brake control portion 19 resets a timer (Step S2), turns the second contacts 28*a* and 28*b* OFF (Step S3), and turns the second semiconductor switch 30 OFF (Step S4), thereby terminating the current processing.

When the absolute value of the speed of the car 1 is larger than the second threshold VL, the second brake control portion 19 determines whether or not time is up as a result of the attainment of the predetermined time Tm by the time measured by the timer (Step S5). When time is up, the second brake control portion 19 turns the second contacts 28*a* and 28*b* OFF (Step S3) and turns the second semiconductor switch 30 OFF (Step S4), thereby terminating the current processing.

When the absolute value of the speed of the car 1 is larger than the second threshold VL and the time measured by the timer is not up, the second brake control portion 19 determines whether or not: the absolute value of the speed of the car 1 is within a range from the first threshold VH to a third threshold Vmax (Step S6). When the absolute value of the speed of the car 1 is outside the above-mentioned range, the second brake control portion 19 turns the second semiconductor switch 30 OFF (Step S4), thereby terminating the current processing.

When the absolute value of the speed of the car 1 is larger than the second threshold VL, the time measured by the timer is not up, and the absolute value of the speed of the car 1 is within the range from the first threshold VH to the third threshold Vmax, the second brake control portion 19 turns the second contacts 28*a* and 28*b* ON (Step S7), and determines whether or not the acceleration of the car 1 is equal to or smaller than the predetermined value αL (Step S8).

When the acceleration of the car 1 is larger than the predetermined value αL, the second brake control portion 19 turns the second semiconductor switch 30 OFF (Step S4), thereby terminating the current processing. When the acceleration of the car 1 is equal to or smaller than the predetermined value αL, the second brake control portion 19 turns the second semiconductor switch 30 ON (Step S9) and starts the timer (Step S10), thereby terminating the current processing.

Figure 5:
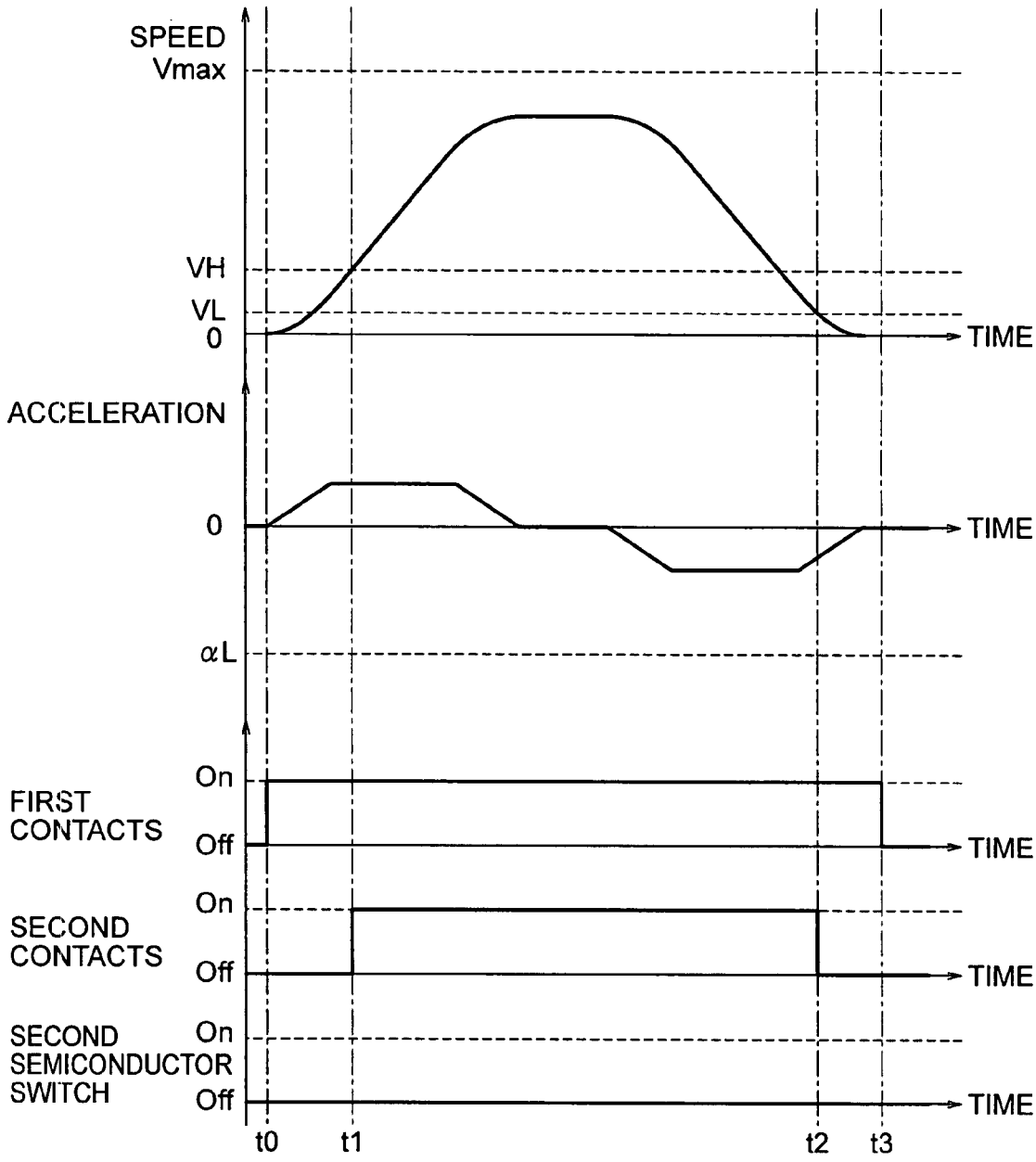
FIG. 5 is a timing chart showing how the speed of a car, the acceleration of the car, the open/closed states of first contacts, of the second contacts, and of a second semiconductor switch are related to one another when the elevator apparatus of FIG. 1 is in normal operation.

FIG. 5 is a timing chart showing how the speed of the car 1, the acceleration of the car 1, the open/closed states of the first contacts 24*a* and 24*b*, of the second contacts 28*a* and 28*b*, and of the second semiconductor switch 30 are related to one another when the elevator apparatus of FIG. 1 is in normal operation.

At a time point t0, the first contacts 24*a* and 24*b* are turned ON immediately before the car 1 starts running, so the brake release coil 12 is supplied with power. As a result, the braking force of the brake device 9 is canceled.

When the speed of the car 1 reaches the first threshold VH at a time point t1, the second contacts 28*a* and 28*b* are turned ON, so the second brake control portion 19 is validated. However, the acceleration of the car 1 is larger than the predetermined value αL during normal operation, so the second semiconductor switch 30 remains OFF. As a result, no power is supplied from the second brake control portion 19 to the brake release coil 12.

When the speed of the car 1 drops to the second threshold VL at a time point t2, the second contacts 28*a* and 28*b* are turned OFF, so the second brake control portion 19 is invalidated. Then, the first contacts 24*a* and 24*b* are turned OFF at a time point t3 after a stop of the car 1, so the braking force of the brake device 9 is applied to the brake pulley 8.

Figure 6:
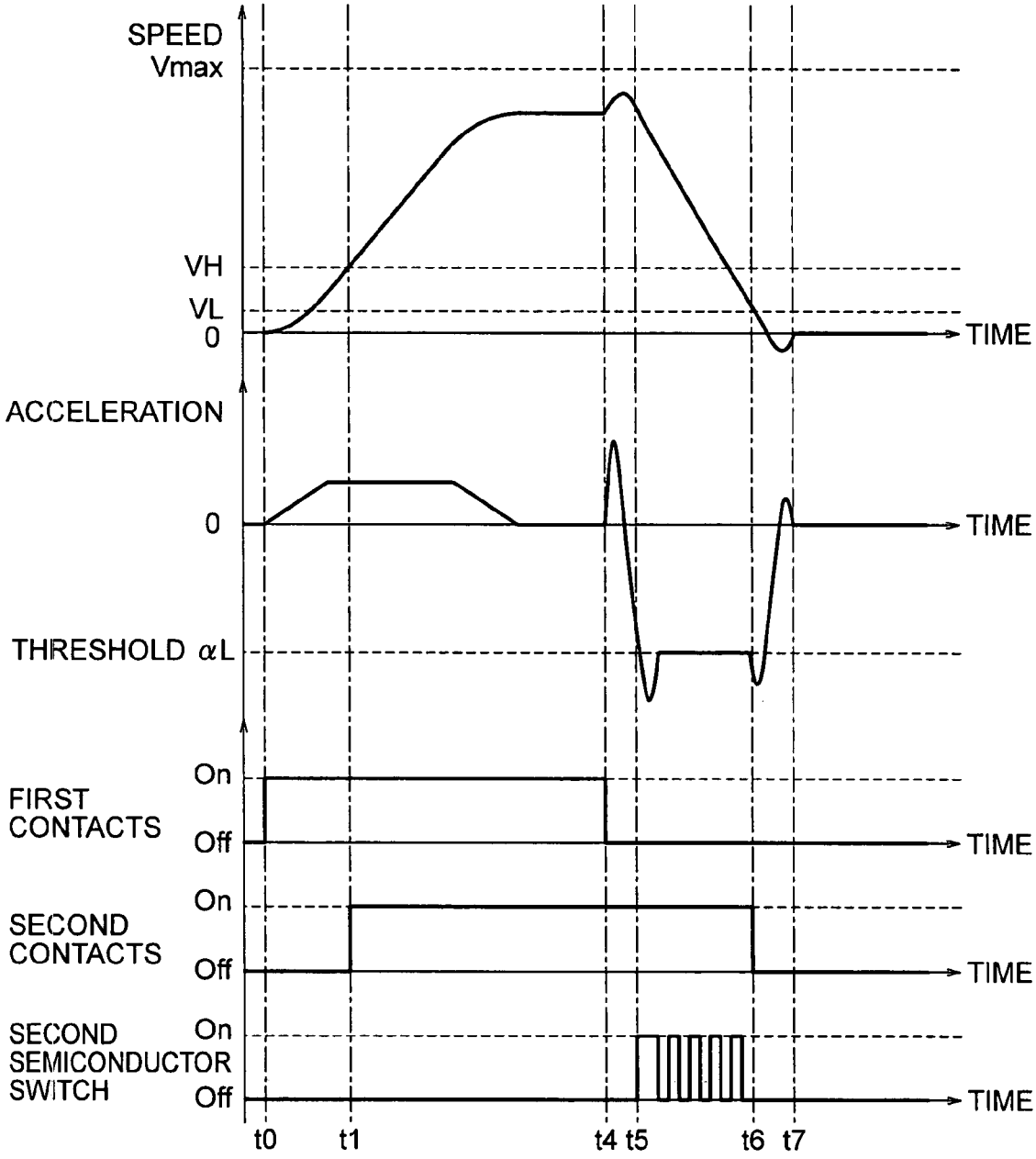
FIG. 6 is a timing chart showing how the speed of the car, the acceleration of the car, the open/closed states of the first contacts, of the second contacts, and of the second semiconductor switch are related to one another when an emergency stop command is issued during operation of the elevator apparatus of FIG. 1.

FIG. 6 is a timing chart showing how the speed of the car 1, the acceleration of the car 1, the open/closed states of the first contacts 24*a* and 24*b*, of the second contacts 28*a* and 28*b*, and of the second semiconductor switch 30 are related to one another when an emergency stop command is issued during operation of the elevator apparatus of FIG. 1.

When the emergency stop command is issued at a time point t4, the first contacts 24*a* and 24*b* are turned OFF, so the supply of power to the brake release coil 12 and the supply of power to the motor 6 are shut off. Thus, the car 1 starts decelerating.

When the acceleration of the car 1 becomes equal to or smaller than the predetermined value αL at a time point t5, the second semiconductor switch 30 is turned ON, so the brake release coil 12 is supplied with power. Thus, the braking force of the brake device 9 is canceled, so the acceleration of the car 1 increases. Then, when the acceleration of the car 1 exceeds the predetermined value αL, the second semiconductor switch 30 is turned OFF, so the braking force of the brake device 9 is applied to the brake pulley 8. By repeating the switching operation of the second semiconductor switch 30 as described above at high speed, the acceleration of the car 1 is held approximately equal to the predetermined value αL.

When the speed of the car 1 becomes equal to or lower than the second threshold VL at a time point t6, the second contacts 28*a* and 28*b* are turned OFF, so the second brake control portion 19 is invalidated. Then, the car 1 is stopped at a time point t7.

In the elevator apparatus configured as described above, the second brake control portion 19 for controlling the deceleration during emergency braking controls the brake device 9 independently of the first brake control portion 18. It is therefore possible to start the operation of emergency braking more reliably and promptly while restraining the deceleration during emergency braking.

The second brake control portion 19 is invalidated when the car 1 reaches the vicinity of each of the terminal floors. It is therefore possible to stop the car 1 more reliably in the vicinity of each of the terminal floors.

In addition, the second brake control portion 19 is invalidated upon the lapse of the predetermined time after the deceleration of the car 1 becomes equal to or larger than the predetermined value. It is therefore possible to limit the time for deceleration control within the predetermined time and hence stop the car 1 more reliably.

Embodiment 2

Figure 7:
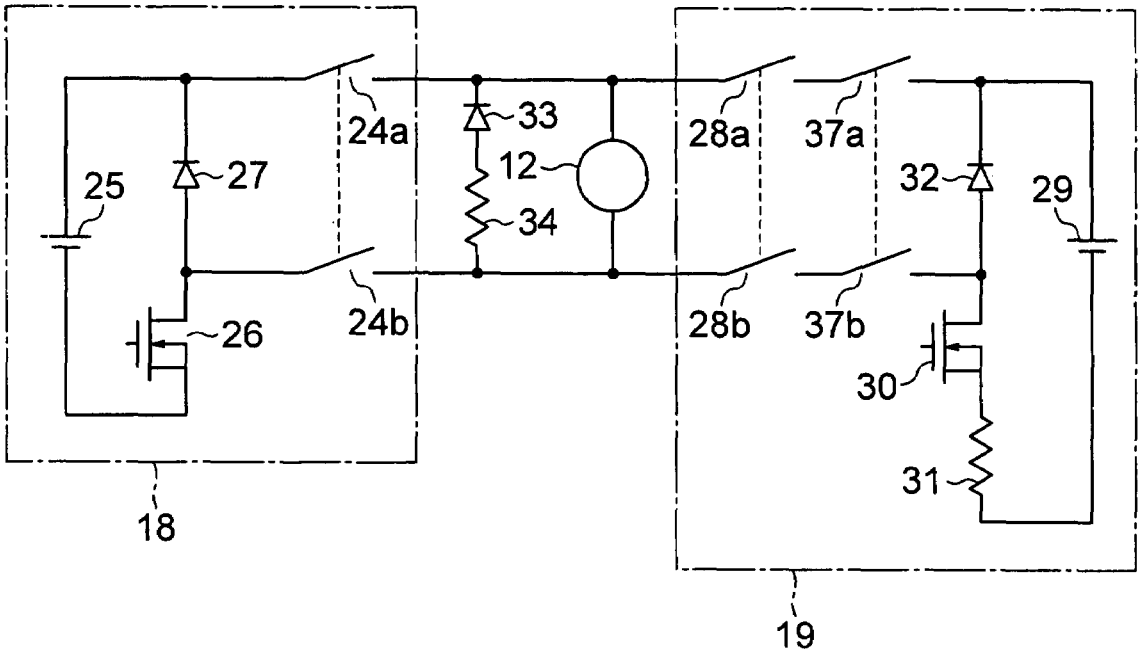
FIG. 7 is a circuit diagram showing a control circuit for controlling a brake device of an elevator apparatus according to Embodiment 2 of the present invention.

Reference will be made next to FIG. 7. FIG. 7 is a circuit diagram showing a control circuit for controlling the brake device 9 for an elevator apparatus according to Embodiment 2 of the present invention. Referring to FIG. 7, the second brake control portion 19 closes the pair of the second contacts 28*a* and 28*b* and a pair of third contacts 37*a* and 37*b* to supply power from the second power supply 29 to the brake release coil 12.

Figure 8:
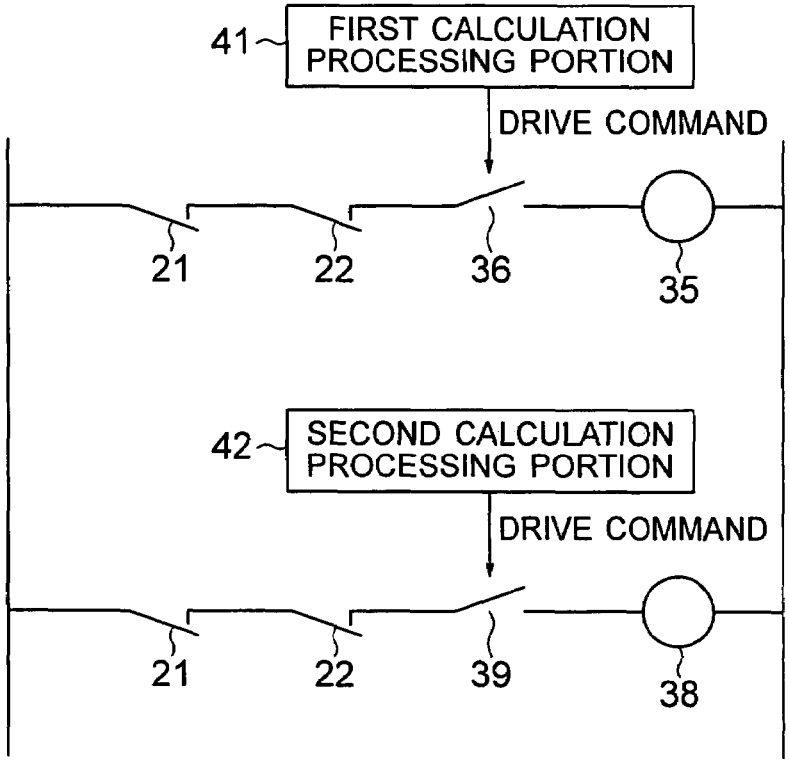
FIG. 8 is a circuit diagram showing a circuit for driving second contacts and third contacts of FIG. 7.

FIG. 8 is a circuit diagram showing a circuit for driving the second contacts 28*a* and 28*b* of FIG. 7 and the third contacts

37*a* and 37*b* of FIG. 7. The third contacts 37*a* and 37*b* are closed by exciting a contact driving coil 38, and opened by shutting off the supply of current to the contact driving coil 38. The upper terminal detection switch 21, the lower terminal detection switch 22, and a brake control switch 39 are connected in series to the contact driving coil 38. This circuit for driving the third contacts 37*a* and 37*b* is connected in parallel to the circuit for driving the second contacts 28*a* and 28*b*.

The second computer constituting the second brake control portion 19 has a first calculation processing unit (first CPU) 41 as a first deceleration monitoring portion, and a second calculation processing unit (second CPU) 42 as a second deceleration monitoring portion. The first calculation processing portion 41 and the second calculation processing portion 42 monitor the deceleration of the car 1 independently of each other. The brake control switch 36 for driving the second contacts 28*a* and 28*b* is closed/opened in accordance with a drive command generated by the first calculation processing portion 41. The brake control switch 39 for driving the third contacts 37*a* and 37*b* is closed/opened in accordance with a drive command generated by the second calculation processing portion 42. Embodiment 2 of the present invention is identical to Embodiment 1 of the present invention in other configurational details.

In the elevator apparatus configured as described above, the second brake control portion 19 is not validated unless the second contacts 28*a* and 28*b* and the third contacts 37*a* and 37*b* are all closed through drive commands from both the first calculation processing portion 41 and the second calculation processing portion 42. It is therefore possible to prevent the second brake control portion 19 from malfunctioning due to an abnormality in the first calculation processing portion 41 or the second calculation processing portion 42. As a result, it is possible to achieve an improvement in reliability.

In each of the foregoing examples, the acceleration of the car 1 is calculated based on the signal from the car speed detector 20. However, the acceleration of the car 1 may be calculated based on an output from, for example, a rotation detector provided on the hoisting machine 4, or an acceleration sensor provided on the car 1.

In each of the foregoing examples, the drive command for driving the second contacts 28*a* and 28*b* is generated by the computer. However, the drive command may be generated by means of an electric circuit for processing analog signals.

Further, in each of the foregoing examples, the presence of the car 1 in the vicinity of each of the terminal floors is detected from the signal from a corresponding one of the terminal detection switches 21 and 22. However, this detection may be carried out using car position information that has been obtained based on a signal from, for example, the car speed detector 20 provided on the speed governor 23, or the rotation detector 13 provided on the hoisting machine 4.

Still further, in each of the foregoing examples, the brake device 9 is provided on the hoisting machine 4. However, the brake device 9 may be provided at another position. In other words, the brake device 9 may be designed as, for example, a car brake mounted on the car 1, or a rope brake for gripping the main rope 3 to brake the car 1.

Further, a brake device having a plurality of brake shoes for performing braking/releasing operations independently of one another may be employed.

The invention claimed is:

1. An elevator apparatus comprising:

a car;

a brake device for stopping the car from running; and a brake control device for controlling the brake device, wherein:

the brake control device has a first brake control portion for operating the brake device to stop the car as an emergency measure upon detection of an abnormality, and a second brake control portion for reducing a braking force of the brake device when a deceleration of the car becomes equal to or larger than a predetermined value during emergency braking operation of the first brake control portion; and the second brake control portion controls the brake device independently of the first brake control portion.

2. The elevator apparatus according to claim 1, wherein:

the second brake control portion is validated when a speed of the car becomes equal to or higher than a first threshold; and the second brake control portion is invalidated when the speed of the car becomes equal to a second threshold lower than the first threshold while the second brake control portion is valid.

3. The elevator apparatus according to claim 1, wherein the second brake control portion is invalidated when the car reaches a vicinity of each of terminal floors.

4. The elevator apparatus according to claim 1, wherein the second brake control portion is invalidated upon a lapse of a predetermined time after the deceleration of the car becomes equal to or Larger than the predetermined value during emergency braking operation of the first brake control portion.

5. The elevator apparatus according to claim 1, wherein the second brake control portion has a first deceleration monitoring portion and a second deceleration monitoring portion for monitoring the deceleration of the car independently of each other, and reduces the braking force of the brake device only when a deceleration detected by both the first deceleration monitoring portion and the second deceleration monitoring portion becomes equal to or larger than the predetermined value.

6. The elevator apparatus according to claim 1, wherein:

the brake device has a brake release coil for generating an electromagnetic force for canceling a braking force; and the second brake control portion has a current limiting resistor connected in series to the brake release coil to limit a magnitude of a current flowing through the brake release coil.

* * * * *